United States Patent [19]

Berger

[11] 4,359,096

[45] Nov. 16, 1982

[54] AQUEOUS FILM-FORMING FOAM FIRE EXTINGUISHER

[75] Inventor: Thomas W. Berger, Roseville, Minn.

[73] Assignee: Minnesota Mining and Manufacturing Company, St. Paul, Minn.

[21] Appl. No.: 140,909

[22] Filed: Apr. 28, 1980

[51] Int. Cl.[3] ..... A62C 1/00

[52] U.S. Cl. ..... 169/44; 252/3; 252/307

[58] Field of Search ..... 169/44, 46, 47, 30, 169/74, 78, 85; 252/3, 6, 8, 8.05, 307, 355, 357, 363.5; 422/261, 276, 278; 222/190

[56] References Cited

U.S. PATENT DOCUMENTS

| | | | |
|---|---|---|---|
| 1,806,025 | 5/1931 | Seaman | 422/276 |
| 2,958,593 | 11/1966 | Hoover et al. | 51/296 |
| 3,258,423 | 6/1966 | Tuue et al. | 252/3 |
| 3,402,137 | 9/1968 | Fischer et al. | 252/363.5 |
| 3,537,121 | 11/1970 | McAvoy | 15/230.12 |
| 3,562,156 | 2/1971 | Francen | 252/8.05 |
| 3,772,195 | 11/1973 | Francen | 169/44 |
| 3,820,557 | 6/1974 | Wartman | 137/268 |
| 3,957,658 | 5/1976 | Chiesa, Jr. et al. | 252/3 |
| 4,090,967 | 5/1978 | Falk | 252/3 |
| 4,149,599 | 4/1979 | Chiesa, Jr. | 169/47 |

FOREIGN PATENT DOCUMENTS

| | | |
|---|---|---|
| 432809 | 3/1973 | Australia . |
| 1435200 | 5/1976 | United Kingdom . |

OTHER PUBLICATIONS

"Better Fire Fighting with UCAR Rapid Water System"; Union Carbide Corp.; 270 Park Ave., N.Y., N.Y.; 1973.

"The Pluronic Grid", Sixth Edition, trade literature of the Wyandotte Chemicals Corporation, pp. 1–4.

"Technical Data on . . . Typical Physical Properties of Pluronic ® Polyols", trade literature of the Wyandotte Chemicals Corporation, pp. 1–4.

3M Bulletin; YFEDIR (1062)MP; "Fire Protection Systems"; 3M Center, St. Paul, Minn., 55101, issued 10/15/1976.

NASA Tech. Brief 71-10336, "Military Specification Fire Extinguishing Agent"; filed Sep. 1971.

Mil. Spec. F24385B–Amendment 1, May 16, 1969.

*Primary Examiner*—Joseph J. Rolla
*Assistant Examiner*—Kenneth Noland
*Attorney, Agent, or Firm*—Cruzan Alexander; Donald M. Sell; David R. Cleveland

[57] ABSTRACT

A shaped body or an aggregation of a plurality of shaped bodies, e.g. pellets, comprising a solid, coalesced mixture of water soluble fluoroaliphatic surfactant and water soluble fluorine-free surfactant is contacted with a flowing stream of a predetermined amount of water, e.g., from the tank of a hand portable fire extinguisher, to produce an aqueous film-forming foam solution of relatively constant composition which can be applied to extinguish a fire or a flammable liquid.

44 Claims, 4 Drawing Figures

AQUEOUS FILM-FORMING FOAM FIRE EXTINGUISHER

This application is a continuation-in-part of application Ser. No. 46,851, filed June 8, 1979, and now abandoned.

This invention relates to a hand portable fire extinguisher for discharging aqueous film-forming foam. In another aspect, it relates to a mixture of water-soluble fluoroaliphatic surfactant and water soluble, fluorine-free surfactant, and to shaped articles of said mixture. In a still further aspect, it relates to a method of extinguishing a fire of flammable liquid, or prevention of such fire, by applying to the surface of said liquid a foam of an aqueous film-forming solution from a hand portable fire extinguisher.

One of the most effective foam agents for extinguishing flammable liquid fires, such as fuel fires, is aqueous film-forming solution which is applied to fires as a foam (such agents commonly abbreviated as "AFFF"), a commercial fire extinguishing agent of this type being that sold as an aqueous liquid concentrate under the registered trademark "Light Water". This agent upon dilution with water has been used successfully to extinguish a host of test fires and such actual fires as a petrochemical storage facility fire, an oil tanker fire which had burned for three days, aircraft fires, and numerous industrial fires of spilled fuel and solvent.

Surfactant compositions useful in or as fire fighting agents, including those of AFFF type, are disclosed, for example, in U.S. Pat. Nos. 3,258,423 (Tuve et al), 3,562,156 (Francen), 3,661,776 (Fletcher et al), 3,772,195 (Francen), 3,957,658 (Chiesa et al), 4,090,967 (Falk) and 4,149,599 (Chiesa). These compositions comprise solutions of water soluble, fluoroaliphatic surfactant, water-soluble, fluorine-free surfactant, and water. Upon application of these compositions with, for example, foam or water/fog equipment, a foam is generated which spreads over and floats on the surface of burning liquid, such as gasoline, forming a vapor-sealing film which extinguishes the fire; the film also secures non-ignited areas and prevents ignition. These compositions are usually provided and stored as aqueous concentrates which are diluted further with water upon use or they can be stored in the diluted form. Typical AFFF fire extinguishing systems are used for fire prevention and control of relatively large hazardous or potentially hazardous flammable liquid bodies and require specially designed proportioning and delivery equipment which function by mixing the requisite amount of concentrate with water to produce the foam.

Recently, hand portable AFFF fire extinguishers have become commercially available, such as the 3M brand "Spoiler" fire extinguisher, described in 3M's bulletin Y-FEBIR(1062)MP, which can be deployed and used to combat relatively small bodies of flammable liquids, such as might be common with automobile garages, paint shops, etc. These fire extinguishers are specially designed and contain about 2.5 gallons (9.5 liters) of premixed, ready-to-use, AFFF agent and are useful in combating small "Class B" as well as "Class A" fires.

Briefly, according to one embodiment of this invention, there is provided a hand portable fire extinguisher comprising a tank loaded with water under pressure, a squeeze lever and valve assembly surmounting the tank and preferably provided with a lock pin and pressure gauge, a delivery hose connected to the valve assembly and terminating in a nozzle, and a cartridge holder connected to the hose upstream of the nozzle and containing a cartridge comprising a shaped, solid body having at least one exposed surface and comprising a solid, water-soluble, coalesced mixture of water-soluble, fluoroaliphatic surfactant and compatible, water-soluble, fluorine-free surfactant, which extinguisher, upon activation, operates by discharging water from the tank through said cartridge holder to contact said surface to dissolve said surfactants and provide via the nozzle a foam of an aqueous film-forming foam ("AFFF") solution of relatively constant composition which can be applied to a body of flammable liquid to extinguish a fire thereof (viz., a "Class B" fire), or prevent such fire, by forming a tough, durable, rapidly-forming and spreading aqueous film on the surface of the flammable liquid in a general manner described in the aforementioned patents. The extinguisher of this invention can also be used to more effectively combat a fire of solid combustible material, such as paper and wood (viz., a "Class A" fire), than a conventional hand portable 2.5-gallon water fire extinguisher. Such a conventional extinguisher can be readily converted, as described below, to an extinguisher of this invention for combating both classes of fire.

The cartridges employed in the fire extinguishing systems of this invention can comprise a single, shaped body comprising the solid surfactant mixture. For example, in one embodiment of cartridge construction, the solid surfactant mixture is in the form of a sheet, with or without a reinforcing matrix (e.g., a sheet of needle felt), laid upon a non-woven, water-insoluble, water-permeable fabric and the assembly rolled up as a coil and loaded as a cartridge in a sleeve, and the loaded sleeve inserted in a cartridge holder. More specifically, the solid surfactant mixture can be heated and pressed into a sheet, trimmed to size, placed in exact alignment on a piece of non-woven fabric, heated to soften, rolled up and inserted as a cartridge into a sleeve. In another example, the shaped body comprising the solid surfactant mixture is in the form of a single, solid cylinder with a star-shaped axial channel for water passage. In another embodiment, the cartridge is a water-permeable aggregation of a plurality (e.g., 50 to 20,000) of shaped bodies (comprising said solid mixture of surfactants) in the form of discrete pellets, beads, rods, etc., of relatively uniform size and shape, the water-permeability of the aggregation being due to the interstitial spaces between the plurality of shaped pellets, etc., providing channels for the water passed through the cartridge.

These types of cartridges, made up of one or more shaped bodies of the solid mixture of surfactants, produce aqueous film-forming solution of relatively constant composition as the surfactant mixture dissolves in the water stream supplied from the tank. The total surface area of the shaped body or bodies of surfactant mixture is a predetermined surface area which is sufficient to produce the AFFF solution with the requisite relatively constant composition at a given discharge rate. Said predetermined surface area will vary, depending upon the particular solid surfactant mixture, the fabrication and formulation of the shaped body or bodies, the number, shape and size of the shaped body or bodies, and the volume, discharge rate, and temperature of the water in the tank. By "relatively constant composition", it is meant that the minimum concentration of the surfactants in the resulting solution during the discharge period of the fire extinguisher is at least about 50 percent, preferably at least 55 percent, of the maximum concentration. To ensure said requisite composition, the amount of shaped body or bodies of the cartridge is such that there will generally be a residual amount of shaped body or bodies left in the cartridge holder after all the water is discharged from the tank.

Figure 1:
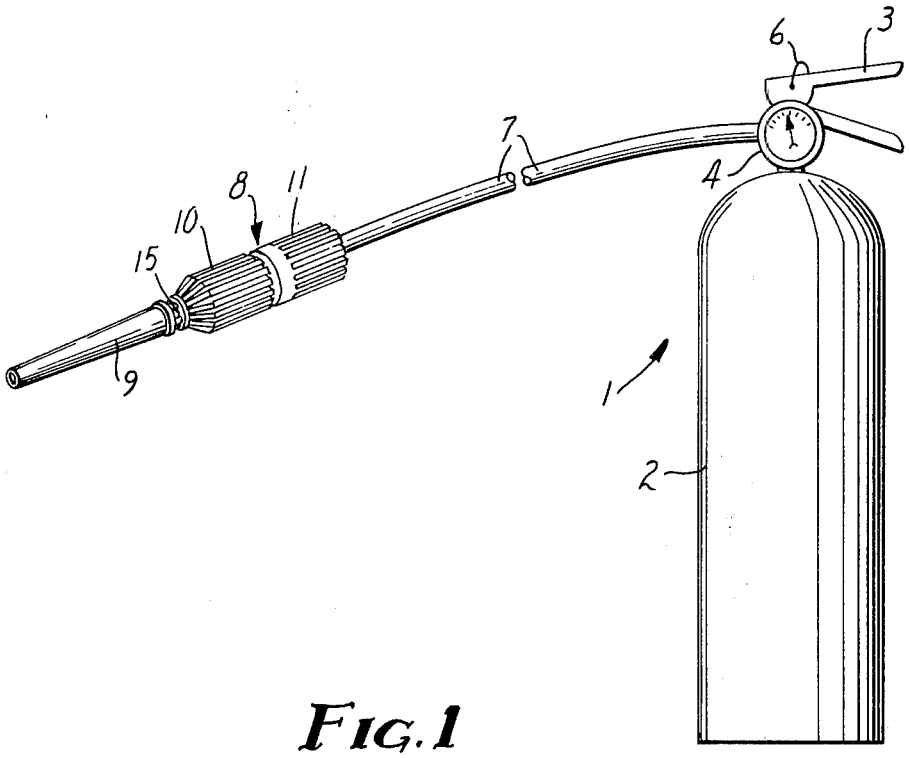
FIG. 1 is a view in elevation of one embodiment of a fire extinguisher of this invention provided with a loaded cartridge holder.

Referring now to the drawing, and initially to FIG. 1, reference number 1 denotes one embodiment of a hand portable fire extinguisher of this invention comprising a tank 2 surmounted by an assembly comprising a squeeze lever 3, pressure gauge 4, valve (not visible), and lock pin 6, this assembly being connected to a delivery hose 7, the end of which is connected to a cartridge holder 8, which is connected to an air aspirating nozzle 9. A conventional, Class A, portable, water fire extinguisher (typically containing about 9.5 liters of water and about 2.8 liters of compressed gas, e.g., air or nitrogen) can be simply modified, for purposes of this invention, by removing its straight stream nozzle and replacing it with the combined cartridge holder-nozzle assembly shown in FIGS. 1 and 2. Alternatively, a conventional Class A fire extinguisher can be modified by cutting its customary delivery hose, interposing a cartridge holder of this invention, affixing the cartridge holder to the cut ends of the hose with suitable clamps or the like, and replacing the customary nozzle with the air aspirating nozzle.

Figure 2:
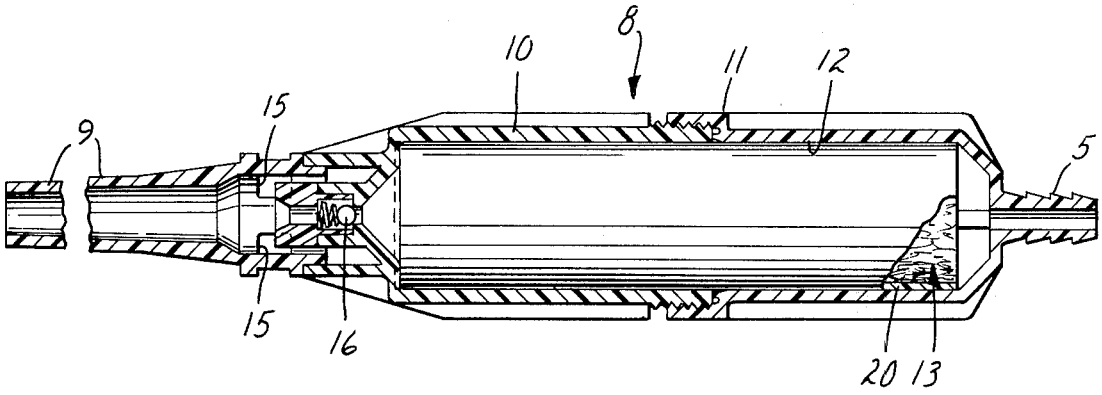
FIG. 2 is a longitudinal view in partial cross-section of the loaded cartridge holder-nozzle of FIG. 1.

FIG. 2 represents one embodiment of a loaded cartridge holder of this invention, wherein a split cylinder made of parts 10 and 11, threaded to engage one another, e.g. by means of a straight thread or spiral buttress thread such as described in NASA Tech Brief 71-10336 (September 1971), is provided with an internal cartridge chamber 12 (e.g., wherein 250 $cm^3$ in volume) adapted to contain within sleeve 20 a cartridge 13 of the invention, the upstream end of cylinder part 11 having a fitting 5 adapted to receive the downstream end of hose 7 and the downstream end of cylinder part 10 being adapted for connection to an air aspirating nozzle 9, the upstream end of which is provided with air openings 15 and with a check valve 16 to prevent fluid, e.g., moist air or water, from flowing into the cartridge holder via the nozzle. The exterior of the cartridge holder can be provided with flutes, as shown, to enable the operator to firmly grasp the holder-nozzle unit during discharge of the extinguisher.

Figure 3:
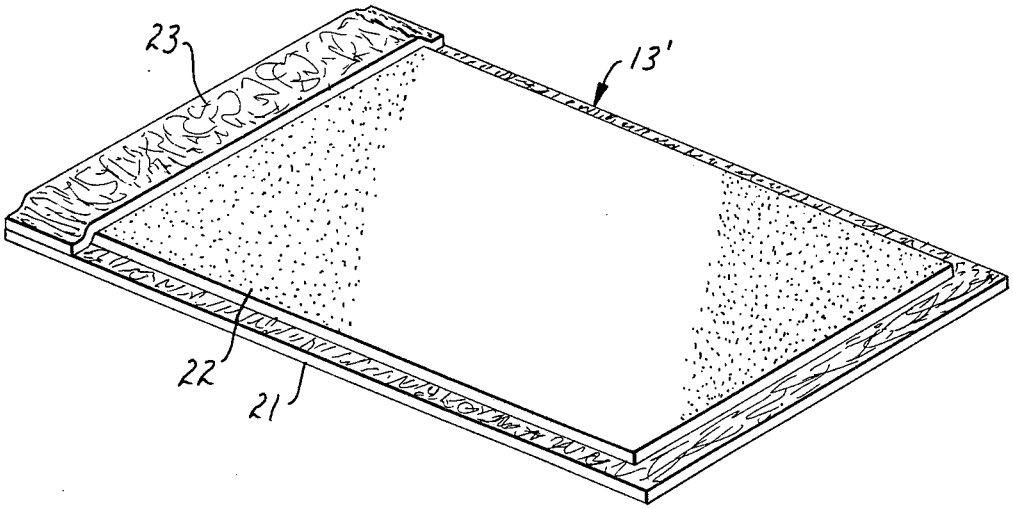
FIG. 3 is an isometric view of one embodiment of a cartridge preform or layup which can be rolled up and loaded in the cartridge holder of FIG. 2.
Figure 4:
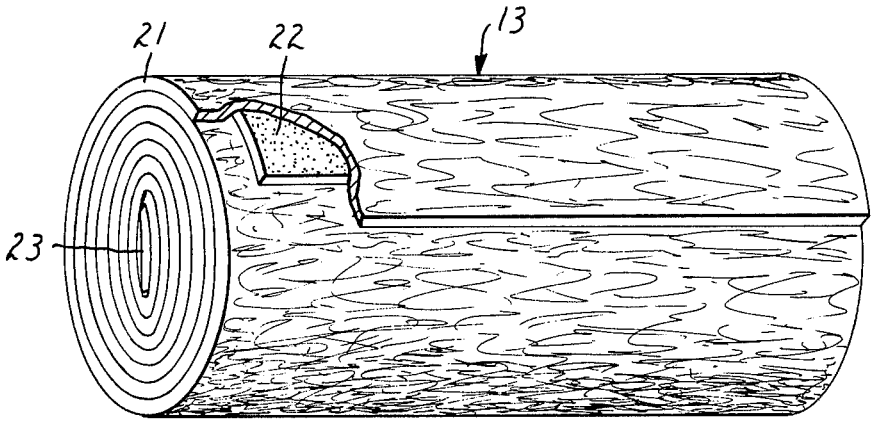
FIG. 4 is an isometric view of a cartridge assembled from the preform of FIG. 3.

In FIG. 3 there is illustrated a cartridge preform or layup 13' comprising a flat, rectangular porous substrate 21 on which is disposed a shaped body 22 of said fluoroaliphatic and fluorine-free surfactants in the form of a slightly smaller, flat rectangular sheet being set back from one end and the sides of the substrate 21, the other end of the sheet 22 being coincident with the other end of substrate 21. When the preform 13' of FIG. 3 is rolled upon itself it assumes the coil or roll form 13 shown in FIG. 4, the last loop of substrate 21 forming the exterior wall of the coil. Thus assembled, cartridge 13 can be inserted in a sleeve 20 (which can be considered as part of the cartridge), made of plastic, metal, cardboard, phenolic-impregnated paper, etc., and placed in the cartridge chamber 12 of cartridge holder 8 of FIG. 2, the porous substrate 21 serving both to separate the portions of the surface of shaped body 22 and to provide channels for the water to pass in contact with said surfaces as it flows from the tank to the nozzle. Optionally, as shown in FIGS. 3 and 4, a second, short, porous substrate 23 can be placed on one end of the shaped body 22 to provide a central channel when the preform 13' is rolled upon itself.

In operation, control of a fire is obtained by removing lock pin 6, squeezing operating lever 3 to open the valve and permit the pressurized water to flow via hose 7 into cartridge holder 8 and discharge from nozzle 9 a foam of an "AFFF" solution of relatively constant composition, viz., a foam of an aqueous film-forming foam solution generally containing 0.05 to 1 wt.% fluoroaliphatic surfactant, the weight ratio of fluoroaliphatic surfactant to fluorine-free surfactant being 10:1 to 1:25. The water, in flowing through the cartridge holder, passes through the channels provided by the porous substrate 21, 23 in contact with the surface of the shaped body 22 to dissolve the mixture of surfactants. The surface area of the shaped body 22, and the rate of dissolution of each component, are relatively constant over the period of discharge. The 2.5 gallons (9.5 liters) of water will be discharged over a 45 to 90 second period at an initial pressure of about 7 $kgf/cm^2$. The extinguisher can be recharged with about 9.5 liters of water and about 2.8 liters of compressed gas and with a new cartridge after drying the cartridge holder.

Where the cartridge used is a single, shaped body, the cartridge can be fabricated in a host of other forms so long as the surface area of the shaped body of surfactants exposed to the flow of water from the tank does not significantly vary during dissolution of the surfactants. For example, the shaped body can be a solid cylinder with an axial channel having the shape of a star in transverse cross-section, the wall of the channel being exposed to the water discharged from the tank. In such embodiment, a porous substrate usually will not be required.

As described above, rather than loading the cartridge holder with a cartridge comprising a single, shaped body of the solid surfactant mixture, the cartridge can comprise a water-permeable aggregation of a plurality of shaped bodies, e.g., pellets, the surface area of which decreases during dissolution. Referring to FIG. 2, cartridge 13 can thus be replaced by an aggregation of a plurality of said shaped bodies. Sleeve 20 can be provided at least on its downstream end with a suitable, liquid-permeable or porous end-cap, such as one or more discs made of a low density, open, non-woven web, e.g., that described in U.S. Pat. Nos. 2,958,593, 3,537,121 and that sold under the trademark "Scotch-Brite". Such discs can be fastened in place if desired, at their periphery to the sleeve, e.g., by a friction-fit or with a water-insoluble adhesive, e.g., a room temperature vulcanizable ("RTV") silicone rubber. Such end-caps will retain the aggregation in the sleeve during handling and during dissolution upon operation of the extinguisher.

The plurality of shaped bodies can be made by shaping the solid mixture of surfactants into the requisite size and shape by extrusion or pelletizing the solid mixture. In order to maintain channels for the water passing through a cartridge made of such shaped bodies, they are preferably fabricated with spherical or oblate shapes, i.e., bodies with mainly round or curved surfaces.

The shaped body or bodies of surfactants used in this invention, e.g. sheet 22 of FIGS. 3 and 4, comprises a solid, coalesced mixture of one or more water-soluble fluoroaliphatic surfactants and one or more compatible, water-soluble fluorine-free surfactants. The mixture is normally solid at ambient temperatures and does not become liquid below about 50° C.

The fluoroaliphatic surfactant contains one or more fluorinated aliphatic radicals ($R_f$) and one or more water-solubilizing polar groups (Z) which are usually connected by suitable linking groups (Q).

Fluoroaliphatic surfactants especially useful are those disclosed in said U.S. Pat. No. 3,562,156. The particular structure of the fluoroaliphatic surfactant is not critical; rather, it is the balance of the physical properties of the compound that determines its usefulness for the purpose. It is necessary that the combination of fluoroaliphatic radical and water-solubilizing group be so balanced as to provide the surfactant with a solubility in water at 25° C. of at least 0.01 percent by weight. It is preferred that the solubility in water be at least about 0.25 percent by weight. The surfactant must be sufficiently surface active to provide a surface tension of less than about 28 dynes/cm, preferably less than 23 dynes/cm, in aqueous solution at a concentration of about 0.25% or less.

If the fluoroaliphatic surfactant is too soluble in hydrocarbon liquid, it will be extracted too rapidly from the aqueous film to provide sufficiently durable coverage. In general, this requires the presence of at least about 20 percent by weight of fluorine, i.e., carbon-bonded fluorine, in the surfactant. To possess these properties, the fluorinated aliphatic radical can be generally described as a fluorinated, saturated, monovalent, non-aromatic radical of at least 3 carbon atoms. The aliphatic chain may be straight, branched, or, if sufficiently large, cyclic and may include oxygen or trivalent nitrogen atoms bonded only to carbon atoms. A fully fluorinated radical is preferred, but hydrogen or chlorine atoms may be present as substituents provided that not more than one atom of either is present for every two carbon atoms, and, preferably, the radical contains at least a terminal perfluoromethyl group. While radicals containing a larger number of carbon atoms will function adequately, compounds containing not more than about 20 carbon atoms are preferred since larger radicals usually represent a less efficient utilization of fluorine than is possible with shorter chains. Fluoroaliphatic radicals containing about 5 to 12 carbon atoms are most preferred.

The water-solubilizing polar group can be an anionic, a cationic, a non-ionic or ampholytic moiety or combinations thereof. Typical anionic groups would include $CO_2H$, $CO_2M$, $SO_2M$, $SO_3H$, $SO_3M$, $OP(OH)_2$, and $OP(OM)_2$, where M is a metallic ion, such as sodium, potassium, calcium, etc. Typical cationic groups would include $NH_2$, NHR, where R is a lower alkyl group such as methyl, ethyl or butyl, $NR'_3A'$, where R' is a lower alkyl group or hydrogen and A' is an anion, such as chloride, sulphate, phosphate, hydroxyl, etc. Typical non-ionic groups would include $—NR_2→O$ and those derived from polyethylene oxide and mixed polyethlene oxide-polypropylene oxide polyols. Typical mixed or ampholytic groups would include $—N(C_2H_4OH)_2$, $—NHC_2H_4NHC_2H_4NH_2$, $—N^+(CH_3)_2C_2H_4CO_2^-$, $[N^+(CH_3)_2C_2H_4COONa]OH^-$, $—N(CH_3)(C_2H_4CO_2H)→O$, and the like.

The linking group is a multivalent, generally divalent, linking group such as alkylene, arylene, sulfonamidoalkylene, carbonamidoalkylene, and the like. In some instances more than one fluoroaliphatic radical may attach to a single linking group and in other instances a single fluoroaliphatic radical may be linked to more than one linking group or may be linked by a single linking group to more than one polar solubilizing group.

A particularly useful class of fluoroaliphatic surfactants which can be used in this invention are those of the formula $(R_f)_n(Q)_mZ$, where $R_f$ is said fluoroaliphatic radical, n is 1 or 2, Q is said linking group, m is an integer of 0 to 2, and Z is said water-solubilizing group.

Representative fluoroaliphatic surfactants useful in this invention include:

$C_8F_{17}SO_3K$
$C_6F_{13}SO_2N(CH_2CHOHCH_2SO_3^-)C_3H_6N^+(CH_3)_2C_2H_4OH$
$C_8F_{17}SO_2NHCH_2C_6H_4SO_3Na$
$C_8F_{17}SO_2NHC_6H_4SO_3Na$
$C_6F_{13}SO_2N(C_3H_6SO_3^-)C_3H_6N^+(CH_3)_2C_2H_4OH$
$C_7F_{15}CONHC_3H_6N^+(CH_3)_2C_2H_4COO^-$
$C_8F_{17}C_2H_4SC_2H_4CONHC(CH_3)_2CH_2SO_3Na$
$C_8F_{17}SO_2N(C_2H_5)C_2H_4P(O)(OH)_2$
$C_6F_{13}SO_2NHC_3H_6N^+(CH_3)_3Cl^-$
$C_8F_{17}SO_2NHC_3H_6N^+(CH_3)_3-O_3SOC_2H_5$
$(CF_3)_2CF(CF_2)_6COOH.H_2NC_2H_5$
$C_7F_{15}COOH.H_2NC_3H_6N^+(CH_3)_2C_2H_4COO^-$
$C_7F_{15}CONHC_3H_6N(CH_3)_2→O$
$C_8F_{17}SO_2N(C_2H_5)CH_2CO_2K$
$C_6F_{13}C_2H_4SO_2N(CH_3)C_2H_4N^+(CH_3)_2C_2H_4COO^-$
$C_6F_{13}SO_2N(CH_2CHOHCH_2SO_3Na)C_3H_6N(CH_3)_2$
$C_8F_{17}C_2H_4SCH(CH_2COONa)COONa$
$C_8F_{17}C_2H_4SC_2H_4CONHC_2H_4N^+(CH_3)_3Cl^-$
$C_{10}F_{20}HOC_6H_4SO_3Na$
$(CF_3)_2CF(CF_2)_4CONHC_2H_4SO_3Na$
$[C_6F_{13}SO_2NHC_2H_6N^+(CH_3)_2C_2H_4OH]OH^-$
$[C_6F_{13}SO_2N(CH_2CH_2OH)C_3H_6N^+(CH_3)C_2H_4OH]OH^-$
$C_6F_{13}SO_2N(CH_2CH_2OH)C_3H_6N(CH_3)_2$ and mixtures thereof.

The water-soluble, fluorine-free surfactants used in this invention are those which are synthetic, imputrescible, hydrocarbon-congruous organic compounds which are water-soluble to at least about 0.02 percent by weight in water at 25° C. and are capable of promoting the film-forming ability of a normally non-film-forming, aqueous fluorocarbon surfactant solution. Such surfactants substantially completely emulsify at least one phase of a mixture of equal volumes of cyclohexane and water at a concentration of about 0.1 to 10 wt.% of the water. Additionally, the fluorine-free surfactants used in this invention must be compatible with the fluoroaliphatic surfactants. Compatibility here means that the two types of surfactants do not interact to produce an inactive product.

The fluorine-free surfactants particularly useful in this invention are those described in the aforementioned patents and they can be selected on the basis of the tests described in U.S. Pat. No. 3,772,195. Representative fluorine-free surfactants useful in the practice of this invention include:

$C_8H_{17}OSO_3Na$
$C_{10}H_{21}OSO_3Na$
$C_{12}H_{25}OSO_3Na$
$C_{10}H_{21}SO_3K$

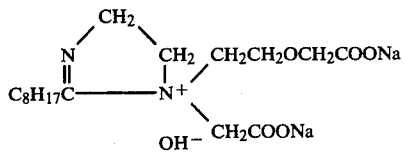

$C_{12}H_{25}N(CH_2CH_2COONa)_2$
$C_8H_{17}C_6H_4O(C_2H_4O)_{30}H$
$C_{12}H_{25}N^+(CH_3)_2C_2H_4SO_3^-$
$C_8H_{17}O_2CCH_2CH(CO_2C_8H_{17})SO_3Na$
$C_{12}H_{25}N^+(CH_3)_3Cl^-$
$(C_8H_{17}O)_2PO_2Na$
$HO(C_2H_4O)_a(C_3H_6O)_b(C_2H_4O)_cH$, MW 6500
$C_{12}H_{25}O(C_2H_4O)_4C_2H_4OSO_3^-NH_4^+$
$C_8H_{17}SC_2H_4CONHC(CH_3)_2CH_2SO_3Na$
$C_{12}H_{25}SO_2N(CH_2COO^-)C_3H_6N^+(CH_3)_3$
$C_{12}H_{25}N(CH_3)_2\rightarrow O$ and mixtures thereof. Certain fluorine-free silicone surfactants are known to be useful in forming AFFF solutions and they can be used here too.

In general, the weight ratio of fluorine-free surfactant to fluoroaliphatic surfactant is in the range of 1:25 to 10:1.

The formulation of the shaped body or bodies can contain, in addition to the two types of surfactants, various adjuvants which aid in the processing or formulation of the shaped body (e.g., solid polyethylene glycols, or methoxy polyetheylene glycols, with number average molecular weights of 1000 to 20,000, preferably 1000 to 6000), foam stabilizers (e.g., polysaccharide foam stabilizers) which stabilize the foam when applied to lower alcohols, ketones, and other flammable polar liquid, adjuvants which modify the softening temperature of the shaped body (e.g., sorbitol), effervescents which aid dissolution (e.g., citric acid with sodium bicarbonate), adjuvants commonly used in preparing AFFF solutions (provided such adjuvants are compatible with the particular surfactant combination used and do not unduly lower the softening point of the desired shaped body below 50° C.), and antioxidants and biocides, such as fungicides, which enhance stability and shelf life of the shaped body or bodies. In some cases individual fluoroaliphatic surfactants and fluorine-free surfactants can provide the desired AFFF solutions, but more frequently mixtures of two or more of each type of the surfactants are more readily available and can be used to provide more desirable AFFF solutions.

A particularly useful formulation for the shaped body comprises the following:

| | |
|---|---|
| $C_6F_{13}SO_2N(CH_2CHOHCH_2SO_3^-)CH_2CH_2CH_2N^+(CH_3)_2CH_2CH_2OH$ | 10–20 wt. % |
| $C_8F_{17}SO_3K$ | 5–20 |
| $C_{10}H_{21}OSO_3Na$ | 40–80 |
| $HO(CH_2CH_2O)_mH$ (ave. mol. wt 3000 to 4000) | 0–20 |
| $HOCH_2(CHOH)_4CH_2OH$ (sorbitol) | 0–20. |

Solid mixtures of surfactants can be prepared by spraying an aqueous solution containing the fluoroaliphatic surfactant and fluorine-free surfactant (in the ratios described above) in a spray drier, such as that manufactured by the Niro Atomizer, Inc. and sold under the trademark "Niro", this spray drier having a 1.26 meter diameter. The spray drier can be operated with an air flow at about 7.5 $m^3$/min. using an air inlet temperature of about 80° C. and an exit air temperature of about 40° C. The solution can be metered onto a high speed (e.g. 24,000 RPM), rotating slotted disc at the top of the unit, which atomizes the solution into tiny droplets. The droplets are dehydrated by the flowing air and the resulting solid particles are collected by means of an air cyclone separator. The particles can be formed into the requisite shaped body or bodies by various means, such as by extrusion, calendering, molding, and the like.

When the cartridge is a single, shaped body, the shaped body is preferably in the form of a sheet (which can be corrugated, embossed, etc., on one or both surfaces to increase surface area) which is rolled up with a water-insoluble, water-permeable, open, resilient, three-dimensional web, such as shown in the drawing. A particularly useful substrate for this purpose is the low-density, open, non-woven, three-dimensional web formed of many interlaced, randomly disposed, flexible, durable, tough, organic fibers which are firmly bonded together at points where they intersect and contact one another by globules of an organic binder, such fibrous material being described in U.S. Pat. Nos. 2,958,593 (Hoover) and 3,537,121 (McAvoy). Commercial articles of such fibrous material with 70–95% void volume and made of thermoplastic fibers are sold under the trademark "Scotch-Brite", e.g., "Scotch-Brite" Type A made of nylon 66 having a 12–15 denier (12–15 g/9000 meters).

Alternatively, the single, shaped body can be prepared by saturating a water-permeable, water-insoluble, reinforcing matrix, e.g., a porous, fibrous web, such as felt, wool batting, etc., with a solution of the mixture of surfactants and removing the solvent. The impregnated web or matrix can then be rolled up with a porous substrate, such as the aforementioned "Scotch-Brite".

Objects and advantages of this invention are illustrated in the following examples in which the amounts given are parts by weight and the water is deionized water, unless indicated otherwise. The controls used were tap water solutions of the particular formulations described, the concentrations of such solutions being indicated in the tables. Where film speeds are reported, they were obtained by placing 2 drops of the AFFF solution onto the surface of cyclohexane contained at room temperature (about 22° C.) in a 5-cm. diameter petri dish and measuring the time for the film to cover the surface.

EXAMPLE 1

The following ingredients were combined, stirred, and heated (85° C.) for about 30 minutes to form a homogeneous solution;

TABLE I

| | |
|---|---|
| 5.88 parts | $C_6F_{13}SO_2N(CH_2CHOHCH_2SO_3^-)CH_2CH_2CH_2N^+(CH_3)_2CH_2CH_2OH$[a] |
| 2.95 | $C_8F_{17}SO_3K$ |
| 0.5 | $C_{12}H_{25}OSO_3Na$ |
| 11.4 | $C_{10}H_{21}OSO_3Na$ |
| 22.1 | $HO(CH_2CH_2O)_nH$[b] |
| 22.1 | $CH_3O(CH_2CH_2O)_nH$[c] |
| 35.0 | Water |

[a] Prepared, following the procedure of Example 7 of Australian Patent Specification 38028/72, by reaction of $C_6F_{13}SO_2N(Na)(CH_2)_3N^+(CH_3)_2CH_2CH_2OH$ with sodium-2-hydroxy-3-chloro-propanesulfonate instead of propanesultone.
[b] "Carbowax" polyethylene glycol 4000 (ave. molecular weight about 3000–3700).
[c] "Carbowax" methoxy polyethylene glycol 2000 (ave. molecular weight about 1900).

The hot solution (211 g) was used to saturate a 24 cm×14 cm piece of needle felt (65/35 polyester/viscose rayon, density 0.088 g/cm$^3$, 0.32 cm thick). The resulting impregnated felt was dried at about 100° C. for 6 hrs. to remove most of the water. The dried felt containing the coalesced mixture was trimmed to about 22 cm×14 cm and placed on a 15 cm×24 cm×0.5 cm piece of "Scotch-Brite" Type A fabric and the combined layers rolled up tightly, with the "Scotch-Brite" fabric on the outside, to form a cartridge 15 cm long with a diameter of about 4 cm. The cartridge was fitted snugly into a galvanized steel pipe (4 cm×15 cm long) threaded on both ends. Pipe caps with adapters for hose were placed on each end of the pipe. The loaded pipe, or cartridge holder, was inserted in the hose line of a standard hand portable, 2.5-gallon, water fire extinguisher, the nozzle of which was replaced with an air-aspirating foam nozzle having a flow rate of about 20 liters/min. at 7 kgf/cm$^2$. The extinguisher was filled with about 9.5 liters of tap water, pressurized to about 7 kgf/cm$^2$. The extinguisher was discharged to yield an AFFF solution having, as shown below, nearly uniform concentration of solute over the discharge period as determined from refractive index measurements of samples taken at 10 sec. intervals;

TABLE II

| Time, sec. | Solute conc., g/l | Film speed, sec. |
|---|---|---|
| 10 | 9 | — |
| 20 | 8 | — |
| 30 | 8 | — |
| 40 | 8 | 18 |
| 50 | 8 | — |
| 60 | 7 | — |
| 70 | 7 | — |
| 80 | 7 | 24 |

EXAMPLE 2

The following ingredients were combined, stirred and heated (85° C.) for about 30 minutes to form a homogeneous solution;

TABLE III

| | |
|---|---|
| 8.6 parts | $C_6F_{13}SO_2N(CH_2CHOHCH_2SO_3^-)CH_2CH_2CH_2N^+(CH_3)_2CH_2CH_2OH$ |
| 4.3 | $C_8F_{17}SO_3K$ |
| 25.7 | $C_{10}H_{21}OSO_3Na$ |
| 0.8 | $C_{12}H_{25}OSO_3Na$ |
| 12.8 | $HO(CH_2CH_2O)_nH$[a] |
| 12.8 | $HOCH_2(CHOH)_4CH_2OH$[b] |
| 35.0 | water |

[a] "Carbowax" 4000
[b] Sorbitol

The aqueous solution (1600 g) was spray dried in a "Niro" utility spray drier using the above-described conditions and 1 wt % fumed silica ("Cabosil" MS-7) was added to yield a free-flowing powder (8 to 65 micrometers).

A 150 g sample of the powdered product was pressed in a platen press at 70 kgf/cm$^2$ to form a coalesced, solid flat sheet having an average thickness of about 0.34 cm. This sheet was trimmed to the dimensions of about 13 cm×19 cm and found to weigh 118 g. It was placed on a 15 cm×24 cm piece of "Scotch-Brite" Type A web centered in the narrow dimension, and positioned with one end (A) coincident with the end of the web, and with a second piece 2.5 cm×15 cm of the web placed over the solid sheet at end A so as to make a sandwich construction. After warming this construction for 1 hour at 66° C. to soften the solid sheet, it was rolled up tightly from end A (with the larger piece of web on the outside) and inserted into a 4 cm×15 cm steel pipe. The pipe was connected to a 2.5-gallon water fire extinguisher as described in Example 1. The extinguisher was filled with about 9.5 liters of tap water, pressurized to about 7 kgf/cm$^2$ with compressed nitrogen gas, and discharged completely over a period of 68 seconds. An AFFF solution of good quality and fairly uniform concentration was produced as shown by the following data obtained on samples collected during discharge;

TABLE IV

| Time, sec. | Refractive index $n_D^{20}$ | Solute conc., g/l | Film speed, sec |
|---|---|---|---|
| 2 | 1.3338 | 7 | 10 |
| 10 | 1.3338 | 7 | 9 |
| 20 | 1.3337 | 6 | 11 |
| 30 | 1.3337 | 6 | 10 |
| 40 | 1.3337 | 6 | 15 |
| 50 | 1.3337 | 6 | 15 |
| 60 | 1.3337 | 6 | 23 |
| 68 | 1.3339 | 8 | 6 |
| Tap Water | 1.3330 | 0 | — |
| Control | 1.3339 | 8 | 6 |

The cartridge was taken apart and the web unrolled. The remaining solid formulation weighed 55 g, showing that 63 g of solid formulation had dissolved, apparently uniformly, resulting in an average concentration of 6.6 g/liter.

EXAMPLE 3

The following ingredients were combined, stirred and heated at about 80° C. for about 30 min. to form a homogeneous solution;

TABLE V

| Parts | |
|---|---|
| 88.4 | $C_6F_{13}SO_2N(CH_2CHOHCH_2SO_3^-)CH_2CH_2CH_2N^+(CH_3)_2$—$CH_2CH_2OH$ |
| 44.2 | $C_8F_{17}SO_3K$ |
| 172 | $C_{10}H_{21}OSO_3Na$ |
| 7.5 | $C_{12}H_{25}OSO_3Na$ |
| 331.5 | $HO(CH_2CH_2O)_nH$[a] |
| 331.5 | $CH_3O(CH_2CH_2O)_nH$[b] |
| 524.9 | Water |

[a] "Carbowax" 4000
[b] "Carbowax" 2000

About 210 g of the above formulation (a 65% solution) was poured over a 24 cm×14 cm piece of needle felt (same as that of Example 1) in a 15 cm×25 cm glass tray. The tray was placed in a 110° C. forced air oven and the water allowed to evaporate from the composition over a 6.5 hour period. The solid composite was turned over and heated in a vacuum oven at 50° C. for 2 hours, trimmed to 22 cm×14 cm, placed on a 24 cm×15 cm piece of "Scotch-Brite" Type A and the combined layers rolled up tightly, with the web on the outside, and inserted into a 15 cm piece of 4 cm threaded steel pipe. The pipe was connected to a hose line of a 2.5-gallon water fire extinguisher as described in Example 2, the extinguisher filled with about 9.5 liters of tap water, and pressurized to about 7 kgf/cm$^2$ with nitrogen gas.

An approximately 2.5 cm layer of heptane (over a layer of water) in a 4.65 m$^2$ square steel pan was ignited and allowed to burn for 30 sec., then extinguished in a period of 71 seconds using essentially all of the contents of the fire extinguisher described above. Details of events are given below;

TABLE VI

| Time, min:sec | Event |
|---|---|
| 0:00 | ignition |
| 0:30 | begin extinguishing fire |
| 0:40 | 15% of fire was extinguished |
| 0:50 | 40% of fire was extinguished |
| 0:60 | 90% of fire was extinguished |
| 1:10 | 97% of fire was extinguished |
| 1:20 | 99% of fire was extinguished |
| 1:30 | 98% of fire was extinguished |
| 1:40 | 99% of fire was extinguished |
| 1:41 | 100% of fire was extinguished |
| 10:56 | attempted to reignite heptane with torch; a minor transient flame was observed, but a fire could not be sustained. |

Weighing of the pipe contents (cartridge) after drying showed that 18 g of solid material remained in the felt carrier, and that 110 g had been used in extinguishing the fire.

EXAMPLE 4

A solution was prepared from the following ingredients;

TABLE VII

| | |
|---|---|
| 5.0 parts | $C_6F_{13}SO_2N(CH_2CHOHCH_2SO_3^-)CH_2CH_2CH_2N^+(CH_3)_2CH_2CH_2OH$ |
| 2.5 | $C_8F_{17}SO_3K$ |
| 9.75 | Mixture[a] of 42 parts $C_8H_{17}OSO_3Na$ and 57 parts $C_{10}H_{21}OSO_3Na$ |
| 0.4 | $C_{12}H_{25}OSO_3Na$ |
| 24.5 | $HO(CH_2CH_2O)_nH$[b] |
| 24.5 | $CH_3O(CH_2CH_2O)_nH$[c] |
| 33.35 | water |

[a] This mixture sold under the trademark "Stepan" 670-15
[b] "Carbowax" 4000
[c] "Carbowax" 2000

The pH of the solution was adjusted to 9.0 with 10% aqueous sodium hydroxide. The foam and surface activity properties, measured in accordance with MIL Specification F-24385B Amendment 1, May 16, 1969, on a solution containing 100 g of solids in 9.5 liters of water, were found to be as follows;

TABLE VIII

| Foam expansion[a] | 25% drain time[b] min. | Surface tension, dynes/cm at 22° C. | Interfacial tension between cyclohexane and water dynes/cm at 22° C. |
|---|---|---|---|
| 8.3 | 4.8 | 15.8 | 4.2 |

[a] Ratio of foam volume to solution volume.
[b] Time for 25% of liquid to drain from bulk foam.

The above formulation was applied to needle felt (same as used in Example 1) at a level which gave 0.39 g of coalesced solids per cm$^2$ after drying. A 10 cm×25 cm piece of the dried impregnated fabric was placed on a 10 cm×27 cm piece of "Scotch-Brite" Type A web and rolled up and placed in a 4 cm×10 cm long pipe cartridge holder as in Example 1. The cartridge holder was attached to a 2.5-gallon water fire extinguisher, the extinguisher filled, pressurized and discharged as described in Example 1. Samples were collected during discharge and concentration of solute and film-forming properties determined to be as follows;

TABLE IX

| Time, sec. | Refractive index, $n_D^{20}$ | Solute conc., g/l | Film speed sec. |
|---|---|---|---|
| 12 | 1.3342 | 10 | 5 |
| 20 | 1.3341 | 9 | 5 |
| 30 | 1.3339 | 8 | 5 |
| 45 | 1.3339 | 8 | 5 |
| 60 | 1.3338 | 7 | 5 |
| Tap water | 1.3330 | 0 | — |
| Control | 1.3346 | 13 | 5 |

A fire test with 9.5 liters of the control solution above, discharged over a 65 second period, from a 2.5-gallon fire extinguisher having an air aspirating nozzle, gave control of a test fire in 35 seconds and total extinguishment in 63 seconds. The test fire was a 4.6 $m^2$ heptane fire run by the method described in Underwriters Laboratories Standard 711.

EXAMPLE 5

The following ingredients were combined, stirred and heated at about 50° C. to form a homogeneous solution with a pH of 4.2;

TABLE X

| Parts | |
|---|---|
| 42.1 | $C_6F_{13}SO_2NHC_3H_6N^+(CH_3)_3Cl^-$ |
| 21.05 | $C_8F_{17}SO_2NHC_3H_6H^+(CH_3)_3Cl^-$ |
| 8.3 | $C_7F_{15}COO^-H_3N^+C_3H_6N^+(CH_3)_2C_2H_4COO^-$ |
| 145.8 | $HO(C_2H_4O)_a(C_3H_6O)_b(C_2H_4O)_cH^a$ |
| 70.9 | $HO(CH_2CH_2O)_nH^b$ |
| 70.9 | $HOCH_2(CHOH)_4CH_2OH^c$ |
| 5.9 | $CH_3COOH$ |
| 3.55 | $CH_3COONa$ |
| 530.5 | water |

[a] "PLURONIC" F-77, molecular weight 6500
[b] "Carbowax" 4000
[c] Sorbitol

This solution (366.2 g) was used to saturate a piece of needle felt fabric (same as used in Example 1) in a glass tray. The dimensions, drying procedures, and cartridge preparation were the same as described in Example 3. The weight of solid, coalesced surfactant mixture in the cartridge was 117.5 g or 0.42 g/$cm^2$ of the impregnated felt.

The cartridge was attached to a 2.5 gallon water fire extinguisher, filled, pressurized and discharged as described in Example 1. An AFFF solution was produced having an effective and nearly uniform concentration of solute over the discharge period as determined from the solute concentration in samples taken at about 10 sec. intervals;

TABLE XI

| Time, sec. | Refractive index $n_D^{20}$ | Solute conc., g/l |
|---|---|---|
| 2 | 1.3333 | 3 |
| 10 | 1.3333 | 3 |
| 20 | 1.3333 | 3 |
| 30 | 1.3333 | 3 |
| 40 | 1.3333 | 3 |
| 50 | 1.3333 | 3 |
| 60 | 1.3333 | 3 |
| 70 | 1.3333 | 3 |
| 76 | 1.3335 | 4 |
| Tap Water | 1.3330 | — |
| Control | 1.3339 | 8 |

Foam expansion and 25% drain time were measured between the 2 and 10 sec. intervals and found to be 2.4 and 3.5 minutes, respectively. Analysis of the cartridge contents after the test showed that 25.2 g of the 117.5 g of solid material had been utilized during discharge. Calculations indicate that 2.7 g solute per liter should have been present in the discharged solution, which is very close to the value obtained. While the AFFF solution was quite dilute, it was adequate to retard vaporization of volatile solvents.

EXAMPLE 6

The following ingredients were combined using agitation and warming;

TABLE XII

| | |
|---|---|
| 11.2 parts | $C_8F_{17}SO_3K$ |
| 22.4 | $C_6F_{13}SO_2N(CH_2CHOHCH_2SO_3^-)CH_2CH_2CH_2N^+(CH_3)_2CH_2CH_2OH$ |
| 350.8 | Sodium alkyl sulfates ("Polystep" B-25, a 38.6% aqueous solution of $C_8H_{17}OSO_3Na$, $C_{10}H_{21}OSO_3Na$, and $C_{12}H_{25}OSO_3Na$ in a weight ratio of about 2:75:23) |

Water was evaporated to yield 305.3 g of solution. About 270 g was poured into a 15 cm×25 cm glass tray containing a 24 cm×14 cm piece of needle felt (same as used in Example 1). The tray and contents were heated at 108° C. for 13 hrs. to remove essentially all of the remaining water (within 2 g of the expected dry weight, i.e. about 1.5% water content). The dried felt was pressed in a platen press at 25° C., trimmed to 13 cm×19 cm, placed on a 15 cm×24 cm piece of nonwoven fabric, warmed to soften the coalesced solids, and the combined materials rolled up and inserted into 4 cm×15 cm threaded steel pipe and fitted with hose adapters.

The resulting cartridge was connected to a standard 2.5-gallon, water fire extinguisher, the extinguisher filled with about 9.5 liters tap water, pressurized to 7 kgf/$cm^2$ and discharged completely over a period of 64 sec. An effective AFFF solution of fairly uniform composition was produced as shown by the following data obtained on samples collected during discharge;

TABLE XIII

| Time, sec. | Refractive index $n_D^{20}$ | Solute conc., g/l | Film speed, sec. | surface tension, dynes/cm at 22° C. | Interfacial tension between cyclohexane and water, dynes/cm at 22° C. |
|---|---|---|---|---|---|
| 2 | 1.3341 | 10 | 60[a] | 17.6 | 4.0 |
| 10 | 1.3337 | 6 | 60[b] | — | — |
| 20 | 1.3336 | 5 | 21 | 18.0 | 3.3 |
| 30 | 1.3337 | 6 | 45 | — | — |
| 40 | 1.3336 | 5 | 14 | 18.0 | 3.3 |
| 50 | 1.3336 | 5 | 18 | — | — |
| 60 | 1.3336 | 5 | 55 | 18.0 | 3.2 |
| 64 | 1.3337 | 6 | 35 | — | — |
| Control | 1.3339 | 8 | 8 | 17.6 | 4.2 |
| Tap Water | 1.3330 | 0 | — | — | — |

[a] 25% of cyclohexane surface covered in 60 sec.
[b] 90% of cyclohexane surface covered in 60 sec.

EXAMPLE 7

The following solid ingredients were sieved individually through a screen and mixed together:

| | |
|---|---|
| 11.3 g | $C_8F_{17}SO_3K$ |
| 22.7 | $C_6F_{13}SO_2N(CH_2CHOHCH_2SO_3^-)CH_2CH_2CH_2N^+(CH_3)_2CH_2CH_2OH$ |
| 135.0 | Sodium alkyl sulfates ("Polystep" B-25 dried solids) |

The mixture was warmed to 100° C. and pressed several times on a platen press to yield a solid, pale amber, waxy coalesced sheet having an average thickness of 0.34 cm. After trimming, the solid sheet had the dimensions 13 cm×19 cm and weighed 114.5 g. It was warmed to 110° C. to soften, placed on a 15 cm×24 cm piece of "Scotch-Brite" Type A web and the combined layers rolled up and inserted in the pipe assembly described earlier. The finished cartridge was connected to a standard 2.5 gallon water fire extinguisher, the extinguisher filled with 9.5 liters tap water, pressurized to 7 kgf/cm$^2$ and discharged completely over a period of 57 seconds. An effective AFFF solution of quite uniform composition was produced as shown by the following data obtained on samples collected during discharge:

TABLE XIV

| Time, sec. | Refractive index $n_D^{20}$ | Solute conc., g/l | Film speed, sec. | Surface tension, dynes/cm at 22° C. | Interfacial tension between cyclohexane and water, dynes/cm at 22° C. |
|---|---|---|---|---|---|
| 2 | 1.3338 | 8 | 11 | — | — |
| 10 | 1.3338 | 8 | 17 | 16.4 | 3.5 |
| 20 | 1.3338 | 8 | 16 | — | — |
| 30 | 1.3337 | 7 | 12 | 16.5 | 3.4 |
| 40 | 1.3337 | 7 | 10 | — | — |
| 50 | 1.3337 | 7 | 9 | 16.7 | 3.4 |
| 57 | 1.3339 | 8 | 11 | — | — |
| Control | 1.3339 | 8 | 5 | 16.2 | 3.9 |
| Tap water | 1.3330 | 0 | — | — | — |

The weight of solid sheet of coalesced solids remaining after discharge was 53.3 g., indicating that 61.2 g had dissolved corresponding to an average concentration of 6.5 g of solute per liter.

EXAMPLE 8

One hundred ninety grams of the powdered surfactant product described in Example 2 were combined and mixed with 19 g of a powdered polysaccharide gum (K 8A13 made by Kelco Division of Merck & Co.) and the resulting mixture pressed in a platen press at 70 kgf/cm$^2$ to form a coalesced, solid, flat sheet. Two sheets 0.25 cm thick were prepared and trimmed to the dimensions 13.3 cm×14.0 cm (wt. 128 g). Using a mold with a saw-tooth pattern (0.18 cm deep valleys, 0.35 cm. between peaks), grooves were pressed into both surfaces of the sheets at right angles to the long dimension. These sheets were placed end-to-end, with the short dimension abutting, on a piece of "SCOTCH-BRITE" fabric, warmed to soften, and the construction rolled up at right angles to the direction of the grooves in the sheets to form a cartridge as described in Example 2. The cartridge was inserted into a polyvinylchloride plastic tube having the dimensions: 15.2 cm in length, 4.48 cm outside diameter, 4.25 cm inside diameter. This assembly was placed in an acrylonitrile/butadiene/styrene (ABS) plastic cartridge holder-nozzle assembly similar to that shown in FIG. 2 (the cartridge holder had a cavity 15.2 cm long and an inner diameter of 4.50 cm). This assembly was connected to a 2.5-gallon, hand portable water fire extinguisher, the extinguisher filled with about 9.5 liters of tap water at 21° C., pressurized to about 7 kgf/cm$^2$ with nitrogen, and discharged completely over a period of 66.5 sec.

Foam samples were taken at the discharge intervals shown and several properties of these samples measured and are summarized below:

TABLE XV

| Time, sec. | Refractive index $n_D^{20}$ | Solute conc., g/l | Foam expansion | 25% drain time, min. | Surface tension, dynes/cm 22° C. | Interfacial tension, dynes/cm 22° C. | Film speed, sec. |
|---|---|---|---|---|---|---|---|
| 5 | 1.337 | 6.1 | 8.6 | 5.3 | 16.8 | 3.3 | 8 |
| 40 | 1.33355 | 4.8 | 7.8 | 2.2 | 16.8 | 3.3 | 13 |
| Control | 1.3338 | 7.0 | — | — | 16.7 | 3.3 | 3.5 |
| Tap Water | 1.3330 | — | — | — | — | — | — |

The weight of the residual solid, coalesced sheets in the cartridge holder weighed 71 g, showing that 57 g had dissolved (44%).

In another example, which was like that described above (except that the polysaccharide was dried to remove adventitious moisture, and the ratio of powdered surfactant product/dried polysaccaride was 188 g/12 g), a higher percentage of the solid formulation dissolved: 74 g out of 128 g. (58%).

EXAMPLE 9

The following ingredients were combined, stirred, and heated about 85° C.) for about 30 min. to form a homogeneous solution:

TABLE XVI

| Parts | |
|---|---|
| 7.9 | $C_6F_{13}SO_2N(CH_2CHOHCH_2SO_3^-)CH_2CH_2CH_2N^+(CH_3)_2CH_2CH_2OH$ |
| 4.0 | $C_8F_{17}SO_3K$ |
| 23.4[a] | $C_{10}H_{21}OSO_3Na$[b] |
| 0.6[a] | $C_{17}H_{35}OSO_3Na$[c] |
| 12 | $HO(CH_2CH_2O)_nH$[d] |
| 12 | $HO(CH_2(CHOH)_4CH_2OH$[e] |

TABLE XVI-continued

| Parts | |
|---|---|
| 0.06 | 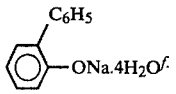 |
| 0.06 | 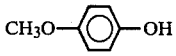 |
| 40 | Water |

[a]Solids basis
[b]"Richonol" 7227
[c]"Niaproof" Anionic 7
[d]"Carbowax" 4000
[e]Sorbitol
[f]"Dowicide" A The aqueous solution (about 10 kg) was spray-dried in a "Niro" utility spray drier using the above-described conditions and about 1 wt.% fumed silica ("Cabosil" MS-7) was added to yield a free-flowing powder having a residual water content of about 1%. About 2.3 kg of this powder was pelletized at ambient temperature in a California Pellet Mill, Model CL, using a die with 0.48 cm diameter orifices to yield small cylinders (pellets) having the following dimensions: diameter about 0.46 cm, length 0.33 to 0.9 cm (average about 0.6 cm), and a density of 1.28 g/cc.

One hundred twenty g of the pellets (having a total surface area of about 1150 $cm^2$) was placed in a phenolic resin impregnated cardboard sleeve (4.48 cm outside diameter, 4.25 cm inside diameter, 15.2 cm long). To retain the pellets in the sleeve as an aggregation, each end of the sleeve was fitted with a 4.3 cm diameter disc of "SCOTCH-BRITE" fabric with the outer surface of the disc positioned about 0.5 cm from the sleeve end, and a bead of RTV silicone rubber was used to seal each disc at its juncture with the sleeve.

The loaded sleeve was inserted in the cartridge holder-nozzle assembly of Example 8 (FIG. 3) and connected to a hand portable, 2.5-gallon, water fire extinguisher. The extinguisher was filled with about 9.5 liters of 21° C. tap water, pressurized with nitrogen gas to about 7 $kgf/cm^2$, and discharged over a period of 61 seconds.

An AFFF solution of good quality and fairly uniform concentration was produced as shown by the following data obtained on samples of foam collected at intervals during discharge:

TABLE XVII

| Time, Sec. | Refractive Index, $n_D^{20}$ | Solute conc., g/l | Film speed, sec. |
|---|---|---|---|
| 2 | 1.3348 | 14.4 | 1.5 |
| 10 | 1.3346 | 12.8 | 1.5 |
| 20 | 1.3343 | 10.4 | 2 |
| 30 | 1.3340 | 8.0 | 3 |
| 40 | 1.3338 | 6.4 | 6 |
| 50 | 1.3338 | 6.4 | 4 |
| 60 | 1.3338 | 6.4 | 5 |
| Tap Water | 1.3330 | 0 | — |

TABLE XVII-continued

| Time, Sec. | Refractive Index, $n_D^{20}$ | Solute conc., g/l | Film speed, sec. |
|---|---|---|---|
| Control | 1.3340 | 8.0 | 4 |

After discharge, the cartridge was taken apart and the remaining pellets were dried in a circulating air oven at 110° for about 6 hours. The weight of the dried solids was 20.7 g, showing that 99.3 g had dissolved.

EXAMPLE 10

The following ingredients were separately pulverized and combined:

TABLE XVIII

| | |
|---|---|
| 13.3 parts | $C_6F_{13}SO_2N(CH_2CHOHCH_2SO_3^-)CH_2CH_2CH_2N^+(CH_3)CH_2CH_2OH$ |
| 6.7 | $C_8F_{17}SO_3K$ |
| 80 | Sodiunm alkylsulfates[a] |

[a]Solids obtained by evaporation of the water from "Polystep" B-25

Using a small laboratory extruder for plastics, the above powdered surfactant mixture was formed into a continuous rod under heat (56°–75° C.) and pressure. The pale amber rod (diameter 0.39 cm, density 1.41 g/cc) was cut into about 12.7 cm lengths, and 81 (total wt. 172.3 g) of these rods (having a total surface area of about 1275 $cm^2$) were packed as an aggregation into a cardboard cartridge sleeve of the same type and dimensions as described in Example 9. The ends of the loaded sleeve were capped with "Scotch-Brite" fabric discs and sealed with RTV silicone adhesive as described in Example 9.

The loaded sleeve was inserted in the cartridge holder-nozzle assembly of Example 8 and connected to a 2.5-gallon, hand portable water fire extinguisher. The extinguisher was filled with about 9.5 liters of tap water, pressurized to 7 $kgf/cm^2$ with nitrogen, and discharged completely over a period of 58.5 sec. An effective AFFF solution of quite uniform composition was produced as shown by the following data obtained on foam samples collected at intervals during discharge:

TABLE XIX

| Time, sec. | Refractive index, $n_D^{20}$ | Solute conc., g/l | Film speed, sec. |
|---|---|---|---|
| 2 | 1.3334 | 3.2 | 24 |
| 10 | 1.3335 | 4.0 | 14 |
| 20 | 1.3335 | 4.0 | 12 |
| 30 | 1.3335 | 4.0 | 12 |
| 40 | 1.3335 | 4.0 | 13 |

TABLE XIX-continued

| Time, sec. | Refractive index, $n_D^{20}$ | Solute conc., g/l | Film speed, sec. |
|---|---|---|---|
| 50 | 1.3335 | 4.0 | 8 |
| Tap water | 1.3330 | 0 | — |
| Control | 1.3340 | 8.0 | 7 |

The undissolved rods of the cartridge weighed 127.3 g (after drying), indicating that 45.0 g of solid had dissolved.

EXAMPLE 11

After drying in a vacuum oven (75° C., 18 hrs) 557 g of the powdered surfactant product of Example 2 and 45.9 g of a powdered polysaccharide gum (K8A13) were combined and thoroughly mixed. This mixture was formed into a rod utilizing a small laboratory extruder at a barrel temperature of about 50° C. and a die temperature of about 65° C. The pale, amber rod (diameter 0.38 cm, density about 1.38 g/cc) was cut in about 1.3 cm lengths, and 120 g of these rod pieces (having a total surface area of about 1050 $cm^2$) were placed as an aggregation into a sleeve of the same type and dimensions as described in Example 9. The ends of the loaded sleeve were capped with "Scotch-Brite" fabric discs and sealed as described in Example 9. The loaded sleeve was inserted in the cartridge holder-nozzle assembly of Example 8 and connected to a 2.5-gallon hand portable water fire extinguisher. The extinguisher was filled with about 9.5 liters of tap water (21° C.), pressurized to 7 $kgf/cm^2$ with nitrogen, and discharged completely over a period of 68 sec. An effective AFFF solution of quite uniform composition and properties was produced as shown by the following data obtained on foam samples collected at intervals during discharge:

TABLE XX

| Time, sec. | Refractive index, $n_D^{20}$ | Solute conc. g/l | Film speed, sec. |
|---|---|---|---|
| 2 | 1.3338 | 6.4 | 8 |
| 10 | 1.3338 | 6.4 | 7 |
| 20 | 1.33375 | 6.0 | 10 |
| 30 | 1.3337 | 5.6 | 12 |
| 40 | 1.3337 | 5.6 | 12 |
| 50 | 1.3337 | 5.6 | 11 |
| 60 | 1.3337 | 5.6 | 13 |
| Tap water | 1.3330 | 0 | — |
| Control | 1.3340 | 8.0 | 3 |

The undissolved pellets of the cartridge weighed 57.7 g (after drying), indicating that 62.3 g had dissolved.

Various modifications and alterations will become apparent to those skilled in the art without departing from the scope and spirit of this invention.

What is claimed is:

1. A hand portable fire extinguisher comprising a tank adapted to contain pressurized water, a valve surmounting said tank, a hose connected to said valve, a cartridge holder connected to said hose, an air aspirating nozzle connected to said cartridge holder, and a cartridge loaded in said cartridge holder and comprising a shaped body comprising a solid, coalesced mixture of water-soluble fluoroaliphatic surfactant and water soluble fluorine-free surfactant, said shaped body having at least one exposed surface adapted to be contacted with water flowing through said cartridge holder to dissolve said shaped body and form an aqueous film-forming foam solution of relatively constant composition over the period of discharge of said water from said tank.

2. The extinguisher of claim 1, wherein said cartridge is a single shaped body comprising said mixture of surfactants.

3. The extinguisher of claim 1, wherein said cartridge comprises a plurality of said shaped bodies in the form of a water-permeable aggregation.

4. The extinguisher of claim 1, wherein said exposed surface is adjacent to a water-insoluble, water-permeable medium so as to provide said cartridge with at least one channel for said water to pass therethrough in contact with said surface.

5. The extinguisher of claim 1, wherein said cartridge comprises a layup comprising two types of sheets in the form of a coil, one type of said sheet comprising said solid mixture and the other type of said sheet comprising a water-insoluble, water-permeable, open, resilient, three-dimensional web.

6. The extingisher of claim 1, wherein said shaped body comprises a composite of said solid mixture distributed throughout a water-insoluble, water-permeable reinforcing matrix.

7. The extinguisher of claim 1, wherein said fluoroaliphatic surfactant has the formula:

$$(R_f)_n(Q)_mZ$$

wherein $R_f$ is a fluorinated, saturated, monovalent organic radical having a terminal perfluoromethyl group, containing from 3 to 20 carbon atoms, in which the carbon atoms of the chain are substituted only by fluorine, chlorine or hydrogen atoms with no more than one hydrogen or chlorine atom for every two carbon atoms, and in which a divalent oxygen or trivalent nitrogen atom, bonded only to carbon atoms, can be present in a skeletal chain, n is 1 or 2, Q is a multivalent linking group, m is an integer from 0 to 2, and Z is a water-solubilizing polar group, and said fluorine-free surfactant is a synthetic, imputrescible, hydrocarbon-congruous, organic, fluorine-free surfactant water-soluble to at least about 0.02 percent by weight in water at 25° C. and which substantially completely emulsifies at least one phase of a mixture of equal volumes of cyclohexane and water at a concentration of about 0.1 to about 10 percent by weight of the water, the weight ratio of fluoroaliphatic surfactant to fluorine-free surfactant in said body being 10:1 to 1:25.

8. The extinguisher of claim 1, wherein said fluoroaliphatic surfactant comprises $C_8F_{17}SO_3K$ and $C_6F_{13}SO_2N(CH_2CHOHCH_2SO_3^+)CH_2CH_2CH_2N^+(CH_3)_2CH_2CH_2OH$, and said fluorine-free surfactant comprises $C_{10}H_{21}OSO_3Na$ and $C_{12}H_{25}OSO_3Na$.

9. The extinguisher of claim 1, wherein said solid mixture further comprises normally solid polyethylene glycol having a number average molecular weight in the range of about 1000 to 6000.

10. A hand portable fire extinguisher comprising a tank containing about 9.5 liters of water and about 2.8 liters of compressed gas at about 7 $kgf/cm^2$, a valve and squeeze lever surmounting said tank, a hose connected to said valve, a cartridge holder connected to said hose, an air aspirating nozzle connected to said cartridge holder, and a replacable cartridge in said cartridge holder and comprising a layup comprising two types of sheets, one type of said sheet comprising a solid, coalesced mixture of water-soluble, fluoroaliphatic surfactant and water-soluble, fluorine-free surfactant in the weight ratio of 10:1 to 1:25 fluoroaliphatic surfactant to fluorine-free surfactant, the other type of said sheet comprising a water-insoluble, water-permeable, open, resilient, three-dimensional web which permits contact of the surface of said one type of sheet with water flowing through said cartridge holder to dissolve said mixture and form an aqueous film-forming foam solution of relatively constant composition over a period of 45 to 90 seconds of discharge of said water from said tank.

11. A hand portable fire extinguisher comprising a tank containing about 9.5 liters of water and about 2.8 liters of compressed gas at about 7 kgf/cm$^2$, a valve and squeeze lever surmounting said tank, a hose connected to said valve, a cartridge holder connected to said hose, an air aspirating nozzle connected to said cartridge holder, and a replacable cartridge in said cartridge holder and comprising a water-permeable aggregation of a plurality of shaped bodies comprising a solid coalesced mixture of water-soluble, fluoroaliphatic surfactant and water-insoluble, fluorine-free surfactant in the weight ratio of 10:1 to 1:25 fluoroaliphatic surfactant to fluorine-free surfactant, said aggregation having exposed surface such that water flowing through said cartridge holder dissolves said mixture to form an aqueous film-forming foam solution of relatively constant composition over a period of 45 to 90 seconds of discharge of said water from said tank.

12. A method of extinguishing a Class A or Class B fire, which comprises flowing a predetermined amount of water under pressure in contact with the surface of at least one shaped body comprising a solid, coalesced, mixture of water-soluble fluoroaliphatic surfactant and water-soluble fluorine-free surfactant to produce an aqueous film-forming foam solution of relatively constant composition, and applying said solution to said fire.

13. The method of claim 12, wherein said fire is a Class B fire of flammable liquid.

14. A shaped body comprising a solid, coalesced, mixture of water-soluble fluoroaliphatic surfactant and water-soluble, fluorine-free surfactant, said shaped body having at least one exposed surface which when contacted with a predetermined amount of flowing water is dissolved and forms an aqueous film-forming foam solution of relatively constant composition.

15. The shaped body of claim 14, comprising a composite comprising said solid mixture distributed throughout a water-insoluble, water permeable reinforcing matrix.

16. The shaped body of claim 14, wherein said solid mixture further comprises normally solid polyethylene glycol having an average molecular weight in the range of about 1000 to 6000.

17. A cartridge comprising a sleeve containing the shaped body of claim 14 and a water-insoluble, water-permeable medium adjacent the surface of said shaped body so as to provide said cartridge with at least one channel for said water to pass therethrough in contact with said surface.

18. A cartridge holder loaded with the shaped body of claim 14.

19. A cartridge holder and air aspirating nozzle assembly, said cartridge holder being loaded with at least one shaped body of claim 14.

20. A water-permeable aggregation of a plurality of shaped bodies having predetermined exposed surface area each comprising a solid, coalesced mixture of water-soluble, fluoroaliphatic surfactant and water-soluble, fluorine-free surfactant, said aggregation which when contacted with a predetermined amount of water flowing at a given rate is dissolved and forms an aqueous film forming foam solution of relatively constant composition.

21. A cartridge comprising a water-permeable aggregation of a plurality of shaped bodies of claim 20.

22. A cartridge comprising a sleeve containing a layup comprising two types of sheets, one type of sheet comprising a shaped body comprising a solid, coalesced, mixture of water-soluble, fluoroaliphatic surfactant and water-soluble, fluorine-free surfactant in the weight ratio of 10:1 to 1:25 fluoroaliphatic surfactant to fluorine-free surfactant, the other type of sheet comprising a water-insoluble, water-permeable, open, resilient, three-dimensional web which permits contact of the surface of said one type of sheet with a predetermined amount of flowing water to dissolve said mixture and form an aqueous film-forming foam solution of relatively constant composition.

23. A solid, coalesced, mixture comprising water-soluble, fluoroaliphatic surfactant and water-soluble, fluorine-free surfactant, said mixture upon being contacted with a predetermined amount of water flowing at a given rate is dissolved to form an aqueous film-forming foam solution of relatively constant composition.

24. A shaped body comprising a solid, coalesced, mixture of water-soluble fluoroaliphatic surfactant and water-soluble, fluorine-free surfactant, wherein said fluoroaliphatic surfactant has the formula $$(R_f)_n(Q)_mZ$$

wherein $R_f$ is a fluorinated, saturated, monovalent, organic radical having a terminal perfluoromethyl group, containing from 3 to 20 carbon atoms, in which the carbon atoms of the chain are substituted only by fluorine, chlorine or hydrogen atoms with no more than one hydrogen or chlorine atom for every two carbon atoms, and in which a divalent oxygen or trivalent nitrogen atom, bonded only to carbon atoms, can be present in the skeletal chain, n is 1 to 2, Q is a multivalent linking group, m is an integer from 0 to 2, and Z is a water-solubilizing polar group, and said fluorine-free surfactant is a synthetic, imputrescible, hydrocarbon-congruous, organic, fluorine-free surfactant water-soluble to at least about 0.02 percent by weight in water at 25° C. and which substantially completely emulsifies at least one phase of a mixture of equal volumes of cyclohexane and water at a concentration of about 0.1 to about 10 percent by weight of the water, the weight ratio of fluoroaliphatic surfactant to fluorine-free surfactant in said shaped body being 10:1 to 1:25, said shaped body having at least one exposed surface which when contacted with a predetermined amount of flowing water is dissolved and forms an aqueous film-forming foam solution of relatively constant composition.

25. A shaped body comprising a solid, coalesced, mixture of water-soluble fluoroaliphatic surfactant and water-soluble, fluorine-free surfactant, wherein said fluoroaliphatic surfactant comprises $C_8F_{17}SO_3K$ and $C_6F_{13}SO_2N(CH_2CHOHCH_2SO_3^-)CH_2CH_2CH_2N^+(CH_3)_2CH_2CH_2OH$, and said fluorine-free surfactant comprises $C_{10}H_{21}OSO_3Na$ and $C_{12}H_{25}OSO_3Na$, said shaped body having at least one exposed surface which when contacted with a predetermined amount of flowing water is dissolved and forms an aqueous film-forming foam solution of relatively constant composition.

26. A cartridge comprising a sleeve containing (a) a shaped body comprising a solid, coalesced, mixture of water-soluble fluoroaliphatic surfactant and water-soluble, fluorine-free surfactant, said shaped body having at least one exposed surface which when contacted with a predetermined amount of flowing water is dissolved and forms an aqueous film-forming foam solution of relatively constant composition, and (b) a water-insoluble, water-permeable medium adjacent at least one said surface of said shaped body so as to provide said cartridge with at least one channel for said water to pass therethrough in contact with said surface, said cartridge further comprising a layup of two types of sheets, one type of said sheet comprising said solid mixture and the other type of sheet comprising a water-insoluble, water-permeable, open, resilient, three-dimensional web.

27. A solid, coalesced, mixture comprising water-soluble, fluoroaliphatic surfactant and water-soluble, fluorine-free surfactant, said mixture upon being contacted with a predetermined amount of water flowing at a given rate is dissolved to form an aqueous film-forming foam solution of relatively constant composition, wherein said fluoroaliphatic surfactant has the formula:

$$(R_f)_n(Q)_mZ$$

wherein $R_f$ is a fluorinated, saturated, monovalent, organic radical having a terminal perfluoromethyl group, containing from 3 to 20 carbon atoms, in which the carbon atoms of the chain are substituted only by fluorine, chlorine or hydrogen atoms with no more than one hydrogen or chlorine atom for every two carbon atoms, and in which a divalent oxygen or trivalent nitrogen atom, bonded only to carbon atoms, can be present in the skeletal chain, n is 0 or 1, Q is a multivalent linking group, m is an integer from 0 to 2, and Z is a water-solubilizing polar group, and said fluorine-free surfactant is a synthetic, imputrescible, hydrocarbon-congruous, organic, fluorine-free surfactant water-soluble to at least about 0.02 percent by weight in water at 25° C. and which substantially completely emulsifies at least one phase of a mixture of equal volumes of cyclohexane and water at a concentration of about 0.1 to about 10 percent by weight of the water, the weight ratio of fluoroaliphatic surfactant to fluorine-free surfactant in said mixture being 10:1 to 1:25.

28. A solid, coalesced, mixture comprising water-soluble, fluoroaliphatic surfactant and water-soluble, fluorine-free surfactant, said mixture upon being contacted with a predetermined amount of water flowing at a given rate is dissolved to form an aqueous film-forming foam solution of relatively constant composition, wherein said fluoroaliphatic surfactant comprises $C_8F_{17}SO_3K$ and $C_6F_{13}SO_2N(CH_2CHOHCH_2SO_3^-)CH_2CH_2CH_2N^+(CH_3)_2CH_2CH_2OH$ and said fluorine-free surfactant comprises $C_{10}H_{21}OSO_3Na$ and $C_{12}H_{25}OSO_3Na$, the weight ratio fluoroaliphatic surfactant to fluorine-free surfactant in said mixture being 10:1 to 1:25.

29. A method of extinguishing a Class A or Class B fire, which comprises flowing a predetermined amount of water under pressure in contact with the surface of at least one shaped body comprising a solid, coalesced, water-soluble mixture comprising fluoroaliphatic surfactant and film-promoting fluorine-free surfactant, to produce an aqueous film-forming foam solution of relatively constant composition containing 0.05 to 1 wt. % of said fluoroaliphatic surfactant, and applying said solution to said fire.

30. A method according to claim 29, wherein said mixture further comprises solid polyethylene glycol or methoxypolyethylene glycol having a number average molecular weight in the range of about 1000 to 20,000.

31. A method according to claim 29, wherein said mixture further comprises solid polyethylene glycol having a number average molecular weight in the range of about 1000 to 6000.

32. One or more shaped bodies each comprising a solid, coalesced, water-soluble mixture, which mixture is normally solid at ambient temperature, does not become liquid below about 50° C., and comprises fluoroaliphatic surfactant and film-promoting fluorine-free surfactant, said shaped bodies when contacted with a predetermined amount of water flowing at a given rate are dissolved, decrease in surface area during dissolution, and provide an aqueous film-forming foam solution of relatively constant composition.

33. Shaped bodies according to claim 32, wherein said mixture contains about 15 to 40 weight percent of said fluoroaliphatic surfactant.

34. Shaped bodies according to claim 32, wherein said mixture further comprises said polyethylene glycol or methoxypolyethylene glycol, having a number average molecular weight in the range of about 1000 to 20,000.

35. Shaped bodies according to claim 32, wherein said mixture further comprises solid polyethylene glycol having a number average molecular weight in the range of about 1000 to 6000.

36. A solid, coalesced, water-soluble mixture comprising fluoroaliphatic surfactant and film-promoting fluorine-free surfactant, said mixture upon being contacted with a predetermined amount of water flowing at a given rate is dissolved to form an aqueous film-forming foam solution of relatively constant composition.

37. A mixture according to claim 36, containing about 15 to 40 weight percent of said fluoroaliphatic surfactant.

38. A mixture according to claim 36, further comprising solid polyethylene glycol or methoxypolyethylene glycol having a number average molecular weight in the range of about 1000 to 20,000.

39. A mixture according to claim 38, further comprising solid polyethylene glycol having a number average molecular weight in the range of about 1000 to 6000.

40. A mixture according to claim 36, further comprising foam stabilizer.

41. A mixture according to claim 36, further comprising material which modifies the softening temperature of said shaped body.

42. A mixture according to claim 36, further comprising effervescent.

43. A mixture according to claim 36, further comprising antioxidant.

44. A mixture according to claim 36, further comprising biocide.

* * * * *

UNITED STATES PATENT AND TRADEMARK OFFICE

CERTIFICATE OF CORRECTION

PATENT NO. : 4,359,096

DATED : November 16, 1982

INVENTOR(S) : Thomas W. Berger

It is certified that error appears in the above—identified patent and that said Letters Patent is hereby corrected as shown below:

Front page, third line of the "References Cited" section, "Tuue" should read -- Tuve --.

Col. 3, line 45, "wherein" should read -- about --.

Col. 19, line 64, "water soluble" should read -- water-soluble --.

Col. 20, line 52, "$_2SO_3$+)$CH_2CH_2CH_2N$+$(CH_3)_2CH_2CH_2OH$" should read -- $_2SO_3$-)$CH_2CH_2CH_2N$+$(CH_3)_2CH_2CH_2OH$ --.

Col. 21, line 21, "water-insoluble" should read -- water-soluble --.

Col. 21, line 24, "surface" should read -- surfaces --.

Col. 21, line 49, "water permeable" should read -- water-permeable --.

Col. 22, line 43, "to" should read -- or --.

UNITED STATES PATENT AND TRADEMARK OFFICE

CERTIFICATE OF CORRECTION

PATENT NO. : 4,359,096

DATED : November 16, 1982

INVENTOR(S) : Thomas W. Berger

It is certified that error appears in the above—identified patent and that said Letters Patent is hereby corrected as shown below:

Col. 23, line 37, "0 or 1," should read -- 1 or 2 --.

Col. 24, line 29, "said" (2nd occurrence) should read --solid--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*